US006125506A

United States Patent [19]

Martin

[11] Patent Number: 6,125,506

[45] Date of Patent: Oct. 3, 2000

[54] SHIELD APPARATUS AND SUPPORT TRACK AND METHOD FOR A SUPPORT ROLLER OF A SECTIONAL DOOR

[75] Inventor: David O. Martin, Salt Lake City, Utah

[73] Assignee: Martin Door Manufacturing, Inc., Salt Lake City, Utah

[21] Appl. No.: 09/152,235

[22] Filed: Sep. 11, 1998

[51] Int. Cl.[7] ..... A47H 15/00; E05D 15/00

[52] U.S. Cl. ..... 16/91; 16/87 R; 16/96 R; 160/201

[58] Field of Search ..... 16/91, 107, DIG. 1, 16/18 CG, 87 R, 87.4 R, 87.6 R, 94 R, 96 R, 96 D; 104/279; 49/425; 160/201; 411/526, 512

[56] References Cited

U.S. PATENT DOCUMENTS

| | | | |
|---|---|---|---|
| 1,037,010 | 8/1912 | Irons | 411/526 |
| 1,603,379 | 10/1926 | Dautrick . | |
| 1,890,348 | 12/1932 | Weatherhead, Jr. | 411/526 |
| 2,321,157 | 6/1943 | Rees | 411/521 |
| 2,351,803 | 6/1944 | Best | 296/44 |
| 2,369,493 | 2/1945 | Rood | 160/201 |
| 2,507,690 | 5/1950 | Burns | 160/172 |
| 2,655,684 | 10/1953 | Robinson | 16/107 |
| 2,962,923 | 12/1960 | Stock | 411/512 |
| 3,412,780 | 11/1968 | Moler | 160/191 |
| 4,120,072 | 10/1978 | Hormann | 16/87 R |
| 4,793,397 | 12/1988 | Whiteman | 160/201 |
| 4,834,603 | 5/1989 | Holton | 411/521 |
| 5,172,744 | 12/1992 | Finch et al. | 160/133 |
| 5,630,459 | 5/1997 | Martin | 160/236 |
| 5,743,057 | 4/1998 | Martin | 52/457 |
| 5,954,111 | 9/1999 | Ochoa | 160/201 |

FOREIGN PATENT DOCUMENTS

| | | | |
|---|---|---|---|
| PCT/DK97/00339 | 8/1997 | Denmark . | |
| 3331968 | 3/1985 | Germany | 49/197 |
| 63265 | 12/1912 | Switzerland | 160/201 |
| WO 98/10165 | 3/1998 | WIPO . | |

*Primary Examiner*—Chuck Y. Mah

*Attorney, Agent, or Firm*—Kirton & McConkie; Berne S. Broadbent; Keith Hargrove

[57] ABSTRACT

A roller shield apparatus and method for shielding a support roller of a sectional door against a finger being inserted between the support roller and the support track. The roller shield is configured as a disc that is mounted to the axle of the support roller so as to be supported in a plane parallel to the support roller and outside of the support track. The support track includes a single hem to eliminate a sharp edge from the support track.

13 Claims, 5 Drawing Sheets

SHIELD APPARATUS AND SUPPORT TRACK AND METHOD FOR A SUPPORT ROLLER OF A SECTIONAL DOOR

BACKGROUND

1. Field of the Invention

This invention relates to a support rollers for a sectional door and, more particularly, to a novel shield apparatus and support track and method for shielding the support roller from a finger being inserted between the support roller and the support track in which the support roller operates; the support track is also selectively modified to provide additional safety features.

2. The Prior Art

Sectional doors are commonly referred to as garage doors and, as their common name implies, are used as the closure for the opening to a garage. The sectional door consists of a plurality of door sections hingedly joined in an edge-to-edge relationship to form the completed sectional door. The ends of each door section are supported upon support rollers which are, in turn, confined to support tracks mounted adjacent the opening to the garage. Each support track has a vertical section and a horizontal section with a curved section providing the transition between the vertical and horizontal sections. The vertical section of track supports the sectional door in its vertical or closed position across the opening while the horizontal section supports the sectional door in its overhead or open position. The hinges between the door sections allow the sectional door to traverse the curved section of track between the vertical and horizontal orientations.

The support track is fabricated from a strip of sheet metal that has been formed with a generally J-shaped cross section so that the support roller is constrained by the curved portion of the J-shape. The axle of the support roller extends outwardly and is anchored to the adjacent door section. The upper end of the J-shaped cross section is formed as a flange extending orthogonally from the leg of the J-shape to provide the support track with an overall cross sectional profile that is a modified, C-shaped profile. The curve of the J-shape supports the roller while the flange prevents the roller from jumping the track. Dimensionally, the length of the J-shape is about 5 or 6 centimeters while the width of the curved portion of the J-shape is about 3 centimeters. The flange is about 3.5 centimeters.

Since the primary use of a sectional door is in a residential garage, that means that it is inherently present in an environment containing children. Unfortunately, the natural curiosity of a child coupled with an inherent tendency for the child to be easily distracted so as to fail to pay proper attention has resulted in serious injury to the fingers of the child. In particular, most residential sectional doors are provided with an electrically driven opener to move the sectional door between its open and closed positions. Children have been known to insert one or more fingers into the interior of the J-shaped track during movement of the sectional door with the result that one of the support rollers has either severely crushed or amputated the fingers. Further, the support roller has a diameter of about 5 centimeters which means that angular opening between the periphery of the support roller and the support track is sufficient to receive a child's finger. The tragic result is that the continued rolling movement of the support roller actually tends to "pull" the rest of the finger under the support roller. Further, even if one were to place some form of moving barrier in front of the support roller, the movement of a finger across the adjacent, exposed edge of the support track will result in the finger being cut by the exposed edge of the support track.

In view of the foregoing it would be an advancement in the art to provide a shield apparatus for shielding a support roller from the insertion of a finger between the support roller and the support track. It would also be an advancement in the art to provide a support roller with a shield that brushes fingers aside to keep the finger from engaging the support roller. It would also be an advancement in the art to provide a support track having a hem on the edge of the support track to eliminate cuts as the roller shield pushes the finger aside. Such a novel invention is disclosed and claimed herein.

BRIEF SUMMARY AND OBJECTS OF THE INVENTION

This invention involves a shield apparatus method for shielding a support roller of a sectional door along with a suitably modified support track. The shield is configured as a circular disc that is mounted to the axle of the support roller exteriorly of the support track where it is in a position to brush away any fingers that may be placed on or in the support track. The diameter of the shield is larger than the support roller so as to provide more adequate shielding for the support roller. The adjacent edge of the support track is also formed into an outwardly curled single hem to preclude the finger from being cut as the finger is brushed aside by the roller shield.

It is, therefore, a primary object of this invention to provide improvements in safety devices for sectional doors.

It is another object of this invention to provide improvements in the method of shielding a support roller for a sectional door.

Another object of this invention is to provide a support roller shield as a disc that is mounted to the axle of the support roller.

Another object of this invention is to provide a roller shield for a support roller, the roller shield being mounted to the axle of the support roller and residing outside the support track and oriented coplanar with the support roller.

Another object of this invention is to provide a roller shield for a support roller, the roller shield being configured as a circular disk having a diameter larger than the diameter of the support roller.

Another object of this invention is to provide a hem on the adjacent edge of the support track to eliminate the risk of the adjacent edge of the support track cutting a finger as the finger is brushed aside by the roller shield.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
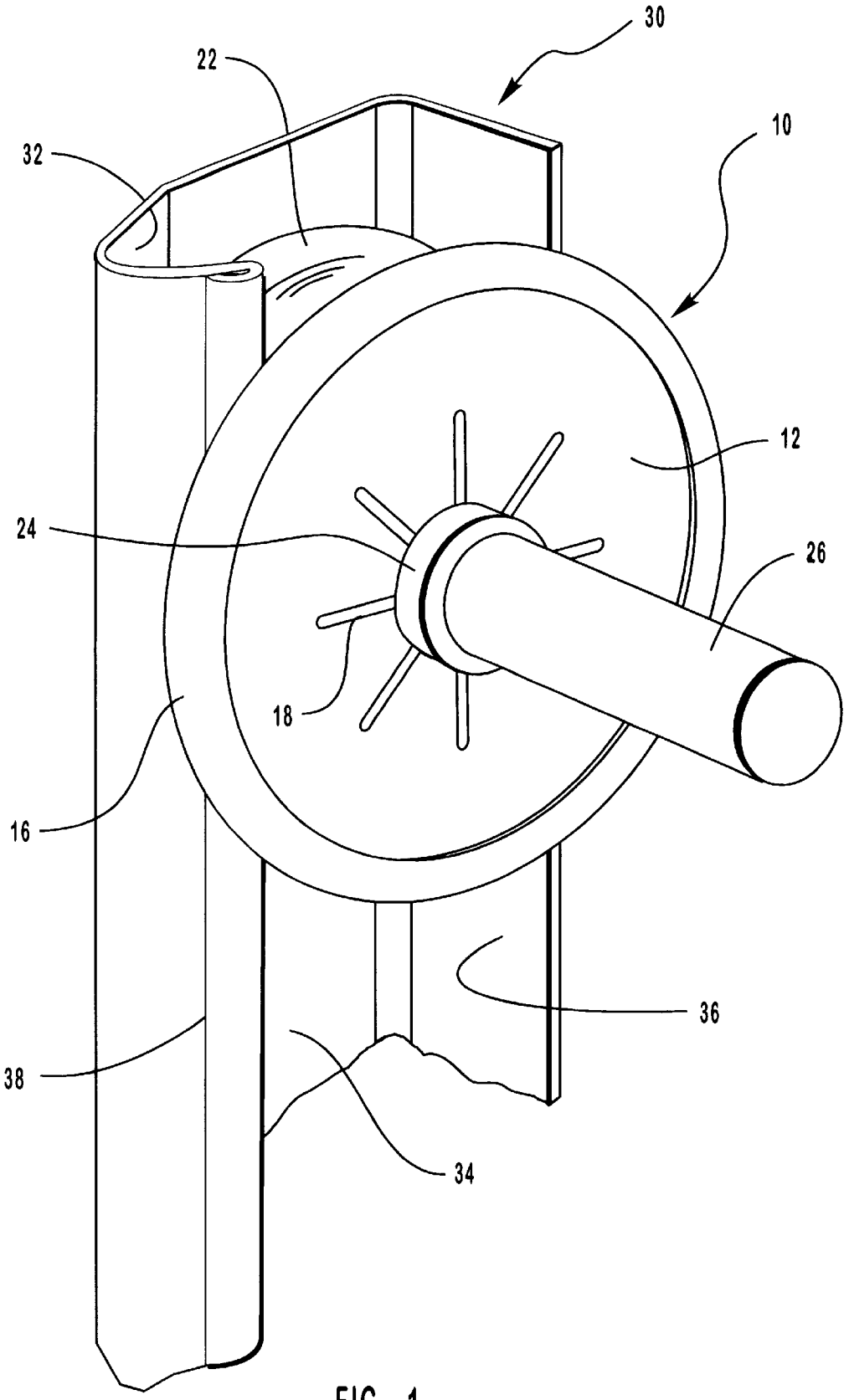
FIG. 1 is a perspective view of the novel roller shield of this invention shown in the environment of a support roller and a support track or the support roller.

The invention is best understood from the following description with reference to the drawing wherein like parts are designated by like numerals throughout and taken in conjunction with the appended claims.

General Discussion

It is a universally accepted fact that children are especially prone to injuries when it comes to their having access to moving machinery, particularly, to moving machinery such as a remotely operated sectional door. These injuries result from, one, the natural curiosity of the child, two, through inattention by the child, or three, by the child being unaware of the dangers that exist when moving machinery is exposed to access by the child. A sectional door represents one particularly ubiquitous item of moving machinery that has been known to cause injuries to children. Of particular concern are the vertical sections of support track on each side of the garage door opening across which the sectional door is moved. Specifically, these support tracks extend upwardly from adjacent the garage floor to the overhead position and are readily accessible to a child for a height of about 2 meters. These injuries occur when the child either deliberately or accidently places his/her fingers inside the J-shaped portion of the support track. The moving roller then either severely crushes or amputates the fingers. Support rollers have a diameter in the range of about 4 to 5 centimeters, which means that the angle of contact between the periphery of the support roller and the support track is wide enough to admit the entrance of a child's finger. Further, the support roller has a thickness of about one centimeter and includes a curvilinear profile on its circumference having a radius of curvature of about one-half centimeter. The curvature of the J-shaped section of the support track is slightly larger so that an angular opening exists between the sides of the support roller and the interior surface of the support track. Either of these angular openings are sufficient to receive a child's fingertip and, more tragically, effectively "pull" the child's finger underneath the support roller as the support roller moves up or down the support track.

However, these types of injuries can be effectively eliminated by the placement of a sweep or "cowcatcher" type of device on the axle of the support roller to sweep aside any fingers that are either deliberately or inadvertently placed on or in the support track. Accordingly, I have invented a novel roller shield apparatus and method for preventing a child's finger from becoming caught between a support roller and the support track. The roller shield is fabricated from a relatively thick sheet material such as plastic, or the like, having sufficient stiffness to sweep aside a child's finger. The roller shield is configured as an enlarged disc having a diameter incrementally larger than the diameter of the roller. The leading circumference of the disc extends beyond the leading circumference of the support roller so that the edge of the shield is the first to contact and thereby sweep aside any finger that may be placed on or in the support track. Experimentally I have found that an increase in the distance by which the leading edge of the roller shield leads the support roller of only about one centimeter is sufficient for the purposes of this invention. Accordingly, a support roller having a diameter of, say, 4 centimeters will be adequately protected by a roller shield having a diameter of about 6 centimeters. The important dimension is that of the roller shield since it must not only extend beyond the leading edge of the support roller but it must also be of such a dimension as to prevent even the most determined child from placing his/her fingers under the support roller.

The sweeping action of the roller shield causes the fingers to be pushed across the exposed edge of the support track. The nature of the manufacturing process of the support track results in an exposed edge which can readily cut a finger pushed along the edge. Accordingly, I have also modified the support track by forming the edge of the track into an outwardly curled single hem so that the rounded edge of the hem serves as the finger contact surface. Importantly, I have formed this single hem on the outside of the track to prevent the exposed edge of the single hem from abrading the support roller and also to eliminate any surface which could otherwise help trap a finger between the support track and the support roller in spite of the presence of my novel roller shield.

Detailed Description

Figure 2:
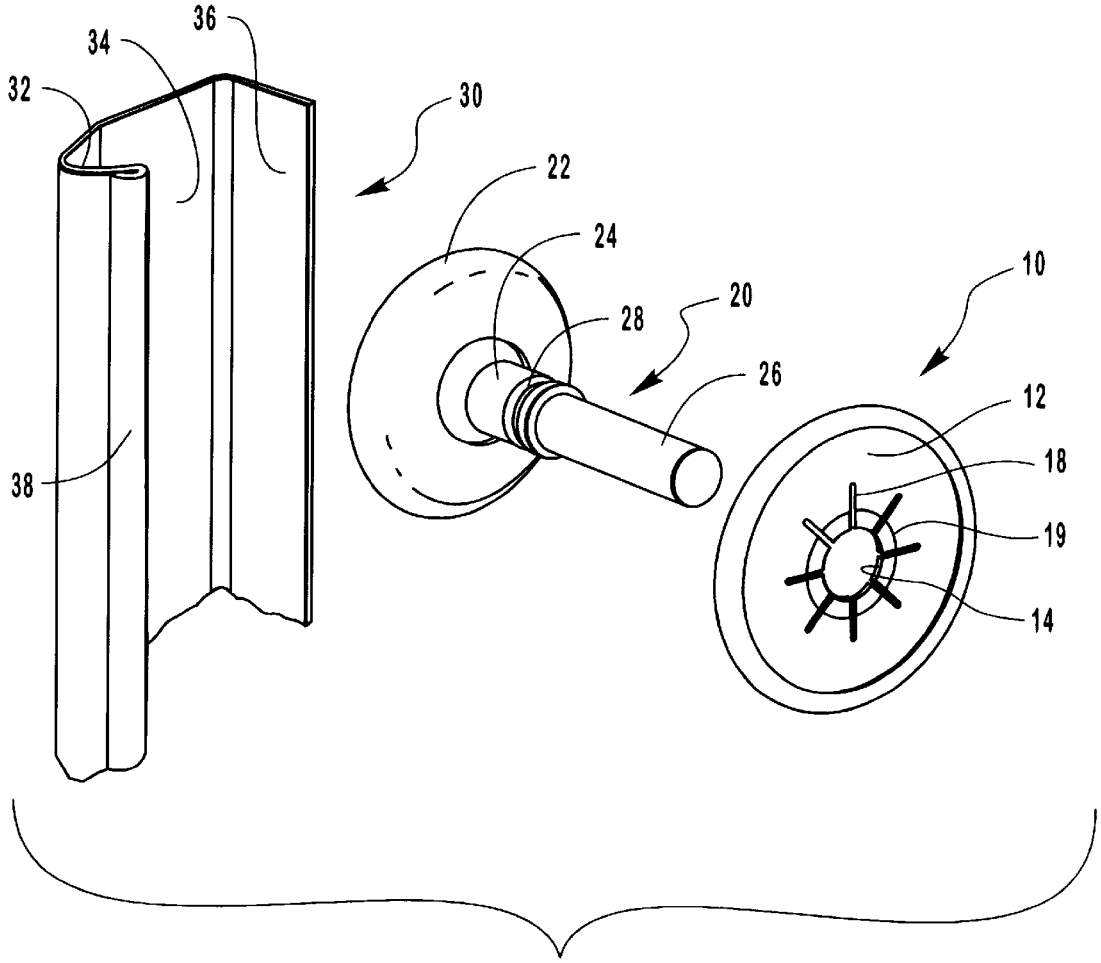
FIG. 2 is an exploded perspective view of the roller shield of FIG. 1 prior to being mounted to the axle of the support roller.

Referring now to FIGS. 1 and 2, the novel roller shield apparatus of this invention is shown generally at 10. Roller shield 10 is configured as disc 12 having a center hole 14 and an outer rim 16. Roller shield 10 also includes a circumferential bevel 19 (FIG. 2) around the periphery of center hole 14. Bevel 19 is designed to enable center hole 14 to be snugly engaged within the confines of circumferential groove 28. Roller shield 10 operates in conjunction with a support roller assembly 20 that is mounted to a sectional door (not shown) and engaged in a support track 30. Support roller assembly 20 is a conventional support roller assembly and includes a support roller 22 rotatably mounted to a neck 24 which is formed as a diametrally enlarged section on the end of an axle 26. Circumferential groove 28 is formed in neck 24 for engaging roller shield 10 therein in a snap-fit relationship. Specifically, the dimensions of center hole 14 are coordinated with the dimensions of circumferential groove 28 so that roller shield 10 can be forced over neck 24 until center hole 14 is received in circumferential groove 28. A plurality of radial tines or slots 18 extend outwardly from center hole 14 and provide sufficient resiliency in disc 12 to accommodate center hole 14 being forced over neck 24. Bevel 19 also snugly nests center hole 14 in circumferential groove 28.

Support track 30 is a vertical section of support track for the sectional door (not shown) and is included in this drawing to facilitate understanding of the operation of my novel roller shield 10. Support track 30 is fabricated from a strip of sheet metal that has been formed into the particular J-shape or modified C-shaped profile shown and includes a curved section 32, a leg section 34, and an L-shaped overhang or flange section 36 which creates the generally C-shaped cross sectional profile to the overall appearance of support track 30. The exposed edge of curved section 32 is formed into an outwardly formed single hem 38. The presence of single hem 38 provides a smooth edge to curved section 32 thereby eliminating any danger of a finger 40 (FIG. 3 PRIOR ART) being cut upon being moved across this edge as will be discussed more fully hereinafter.

Support roller 22 is designed to travel along the length of curved section 32 of support track 30 and is retained in support track 30 by the presence of flange section 36.

Support track 30 is configured to be relatively robust in order to both support the sectional door (not shown) as well as withstand the forces imposed thereon when the sectional door is moved between its open and closed positions. Accordingly, each sectional door is supported on support track 30 by a plurality of roller assembly 20, only one of which is shown herein.

Roller shield 10, once mounted to roller assembly 20 becomes, in effect, a permanent part of roller assembly 20. The diameter of roller shield 10 is also sufficiently larger than support roller 22 to cause roller shield 10 to extend beyond the external periphery of both overhang section 36 and curved section 32 thereby enclosing the side opening of support track 30 and effectively shielding support roller 22 inside support track 30.

Figure 3:
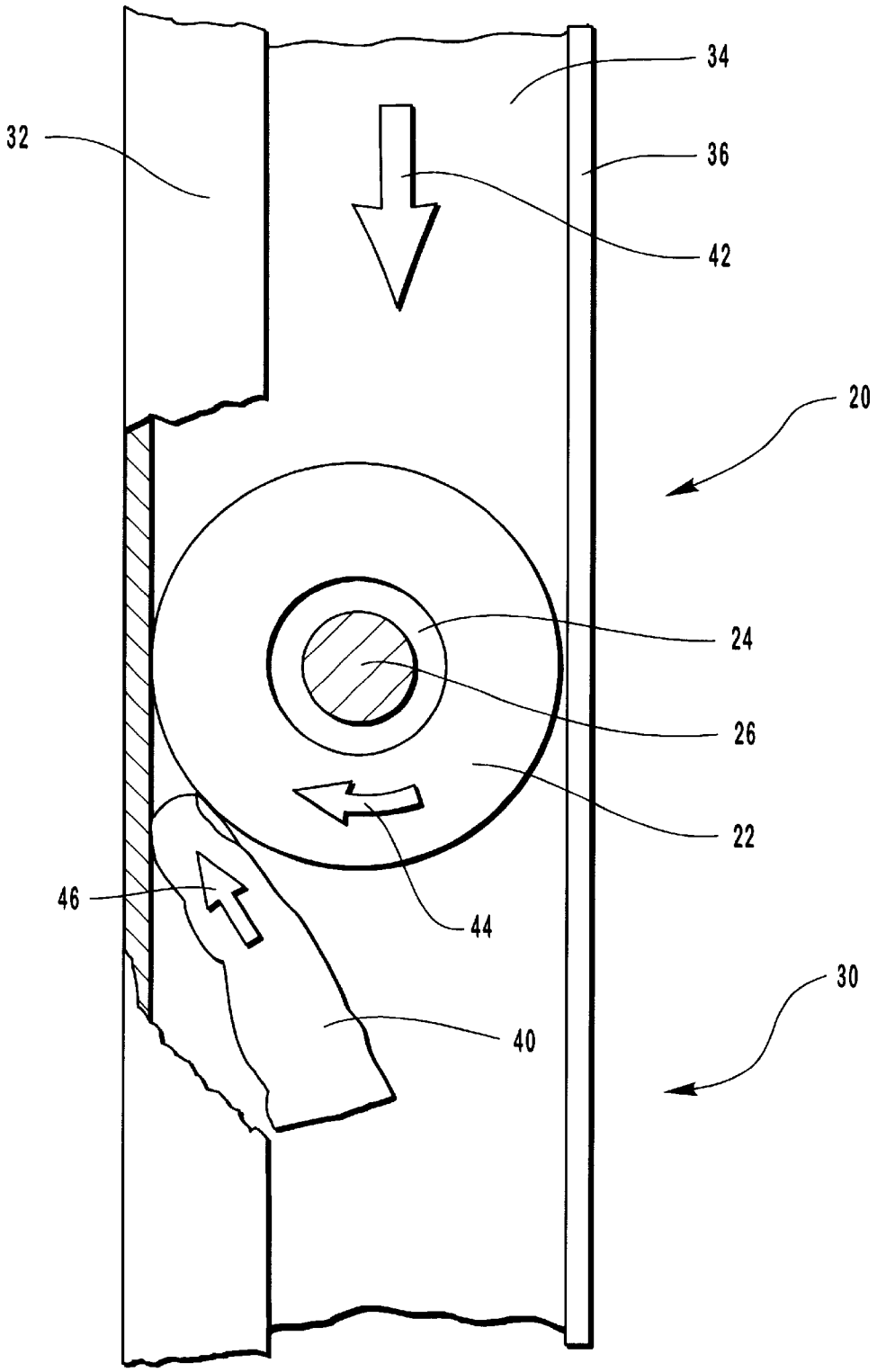
FIG. 3 ( PRIOR ART )
FIG. 3 (PRIOR ART) is a side elevation of a support roller operating in a support track in the absence of my novel roller shield with portions of the support track broken away for ease of presentation a d shown in the environment of a child's finger.

Referring now to FIG. 3 (PRIOR ART) support track 30 and roller assembly 20 are shown in the environment of a child's finger 40. Portions of curved section 32 are broken away to schematically illustrate what happens when finger 40 is placed inside support track 30 during movement of roller assembly 20. Movement of roller assembly 20 is shown schematically by movement arrow 42 which causes roller 22 to rotate as shown schematically by rotation arrow 44. This rolling action of roller 22 grips the tip of finger 40 against the inside surface of curved section 32 thereby holding finger 40 from being retracted. Continued movement of roller assembly 20 causes roller 22 to ride over finger 40 with the net effect that finger 40 is "pulled" under roller 22 as shown schematically by pulling arrow 46. Clearly, of course, finger 40 is subjected to substantial injury by being crushed between roller 22 and the surface of J-shaped track section 32. Additionally, if finger 40 is only pushed across the exposed edge of curved section 32 (in the absence of single hem 38) finger 40 will most probably be cut by this action.

Figure 4:
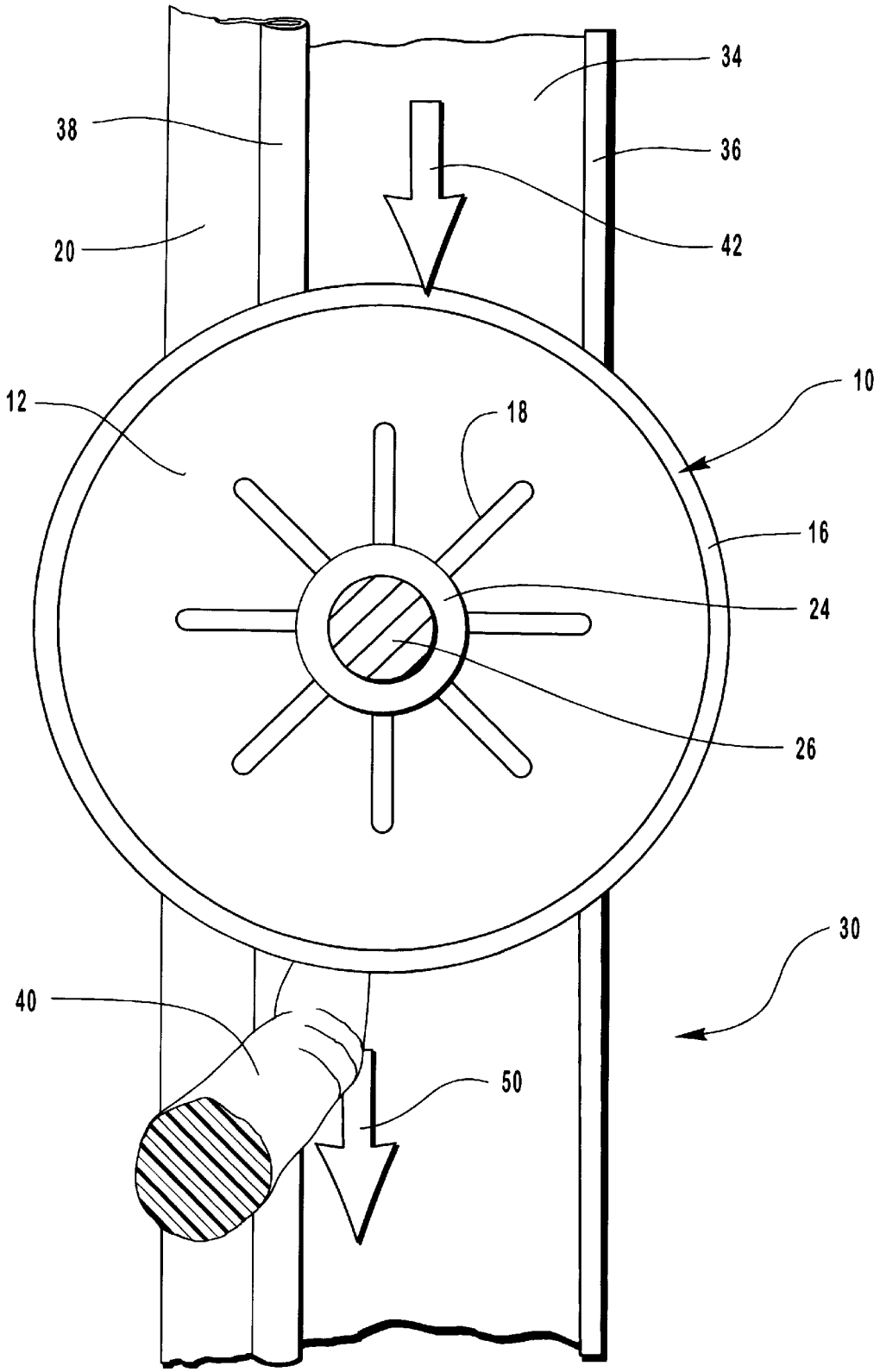
FIG. 4 is a side elevation of my novel roller shield mounted to the axle of a support roller operating in a support track and shown in the environment of a child's finger.
Figure 5:
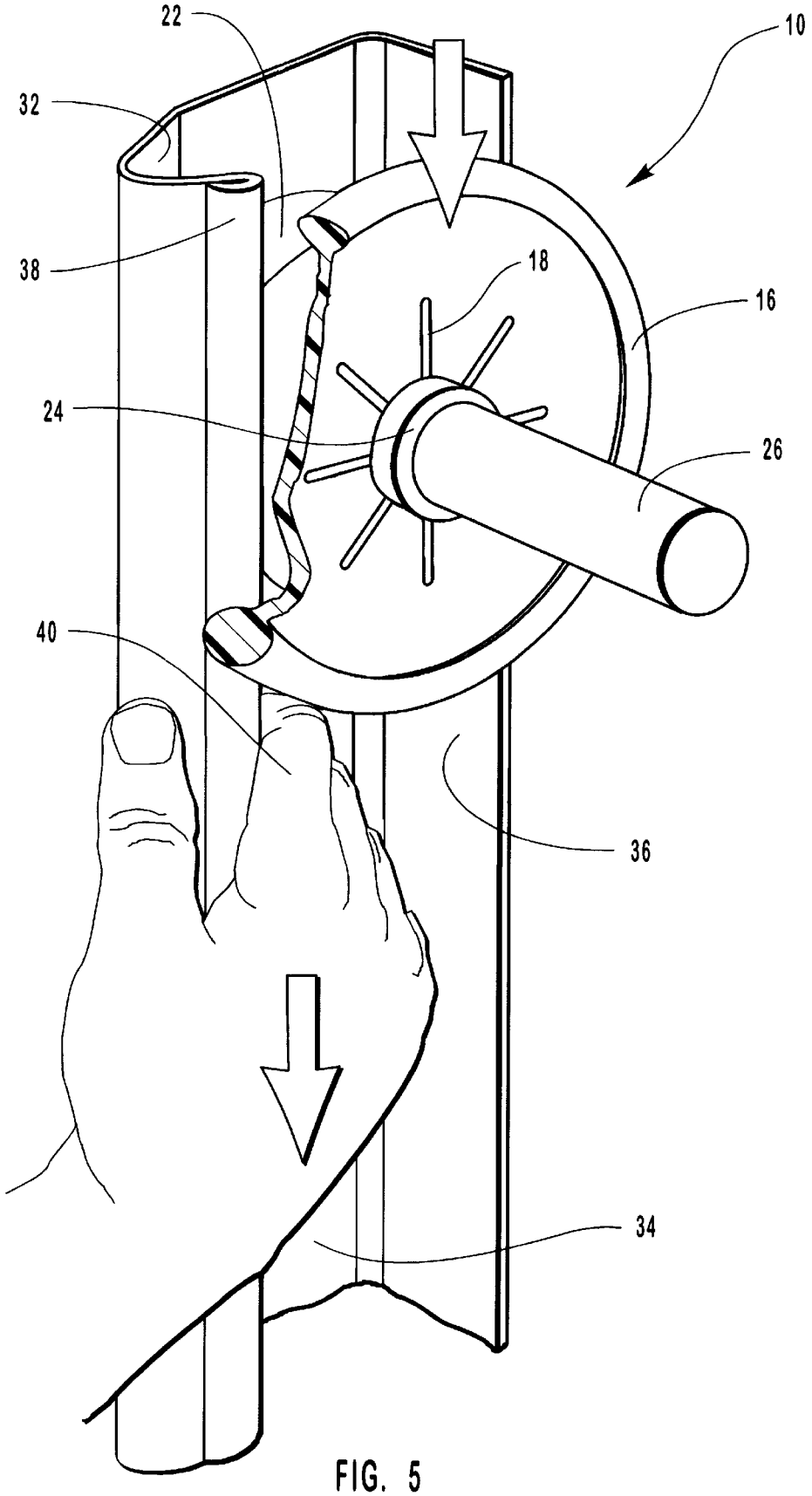
FIG. 5 is an enlarged perspective view of my novel roller shield preventing a child's hand from being injured by a support roller, a portion of the roller shield being broken away to reveal the spatial separation between the child's hand and the support roller.

Referring now to FIGS. 4 and 5, roller shield 10 is shown mounted to neck 24 to provide roller assembly 20 with the unique shielding action of this invention. Specifically, as roller assembly 20 is moved in track 30 as shown by movement arrow 42 finger 40 is swept aside by roller shield 10 as shown schematically by sweep arrow 50. Roller shield 10 not only sweeps aside finger 40 but roller shield 10 also prevents the tip of finger 40 from becoming trapped between support roller 22 (FIG. 5) and the surface of curved section 32. Further, roller shield 10 also prevents finger 40 from being caught between roller 22 and flange section 36.

The Method

The method of this invention involves forming roller shield 10 out of any suitable material such as a plastic, card stock, metal, or the like, and mounting it to roller assembly 20. In the illustrated embodiment herein, circumferential groove 28 is formed in neck 24 of roller assembly 20 to engage roller shield 10 by having center hole 14 of roller shield 10 received therein in a snap-fit relationship. Once roller shield 10 has been mounted to roller assembly 20 it essentially becomes a permanent part of roller assembly 20. As such, roller shield 10 prevents finger 40 from becoming crushed between support roller 22 and the inside surface of support track 30, whether curved section 32 or flange section 36. Single hem 30 is formed along the exposed edge of curved section 32 and thus presents a smooth, non-cutting edge to support track 30 thereby precluding finger 40 from being cut as finger 40 is brushed aside by the movement of roller shield 10.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A support roller and a roller shield comprising:
- a support roller;
- a roller shield comprising:
  - a circular disc fabricated from a sheet material;
  - a center hole in said disc;
  - a plurality of radial slots in said disc, said radial slots extending outwardly from said center hole; and
  - a rim around the periphery of said disc;
- a circumferential groove in a support axle for the support roller, said circumferential groove being dimensionally configured to receive said center hole in a snap fit relationship.

2. The support roller and a roller shield defined in claim 1 wherein said sheet material includes a predetermined degree of flexibility to accommodate said snap fit relationship between said center hole and said circumferential groove.

3. The support roller and a roller shield defined in claim 1 herein said center hole includes a bevel around the periphery of said center hole.

4. The support roller and a shield roller defined in claim 1 wherein said disc has a diameter incrementally larger than the diameter of the support roller.

5. A track support system comprising:
- a track having a channel and at least one longitudinal folded edge along said channel;
- a roller support axle;
- a roller axially mounted to one end of the roller support axle and engaged within said channel;
- a roller shield, axially mounted to the roller support proximate the roller and outside the channel, the roller shield extending beyond the track sufficiently enough to shield an adjacent section of channel within the track in which the roller travels.

6. The track support system of claim 5 wherein the roller shield comprises a center hole to receive the roller support axle.

7. The track support system of claim 6 wherein the roller shield comprises a plurality of radial tines to define the center hole and mate with a groove formed on the roller support axle.

8. The track support system of claim 7 wherein the roller shield comprises a bevel edge about the center hole.

9. The track support system of claim 5 wherein the roller shield comprises a sheet material having a predetermined resiliency.

10. The track support system of claim 5 wherein the roller shield is formed as a disc.

11. The track support system of claim 10 wherein the roller shield has a diameter larger than the roller.

12. The track support system of claim 5 wherein the roller shield further comprises an enlarged rim around its outer edge.

13. The track support system of claim 5 wherein the roller shield is formed of a disc having a center hole to axially mount to the roller support axle, the disc having an enlarged rim around its outer edge, said center hole and enlarged rim being substantially coplanar.

* * * * *

UNITED STATES PATENT AND TRADEMARK OFFICE

CERTIFICATE OF CORRECTION

PATENT NO. : 6,125,506
DATED : October 3, 2000
INVENTOR(S) : David O. Martin

It is certified that error appears in the above-identified patent and that said Letters Patent is hereby corrected as shown below:

Column 1,
Line 7, should read "relates to a support roller" instead of "relates to a support rollers"

Column 2,
Line 66, should read "ease of presentation and shown" instead of "ease of presentation a d shown"

Column 5,
Line 60, should read "Single hem 38" instead of "Single hem 30"

Column 6,
Line 26, should read "1 wherein said center" instead of "1 herein said center"

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*